United States Patent [19]

Lang

[11] Patent Number: 4,882,956

[45] Date of Patent: Nov. 28, 1989

[54] EMERGENCY HAMMER

[75] Inventor: Manfred Lang, Wuppertal, Fed. Rep. of Germany

[73] Assignee: Gebr. Happich GmbH, Fed. Rep. of Germany

[21] Appl. No.: 641,480

[22] Filed: Aug. 16, 1984

[30] Foreign Application Priority Data

Aug. 29, 1983 [DE] Fed. Rep. of Germany ..... 3331081

[51] Int. Cl.[4] ..... B25D 1/00

[52] U.S. Cl. ..... 81/20

[58] Field of Search ..... 145/29 R, 29 D; 81/20

[56] References Cited

U.S. PATENT DOCUMENTS

| | | | |
|---|---|---|---|
| D. 56,553 | 11/1920 | Clay | 145/29 D |
| 271,303 | 1/1883 | Blaker | 145/29 R |
| 634,016 | 10/1899 | Mueller | 145/29 R |
| 827,658 | 7/1906 | Paddock | 145/29 R |
| 850,024 | 4/1907 | Lewis | 145/29 R |
| 1,121,085 | 12/1914 | Fitzgerald | 145/29 R |
| 1,242,307 | 10/1917 | Babson . | |
| 1,924,015 | 8/1933 | Balth | 145/29 R |
| 1,972,540 | 9/1934 | Teate | 145/29 A |
| 2,337,440 | 12/1943 | Arrowood | 145/29 R |
| 3,596,342 | 8/1971 | Willfurth | 145/29 R |
| 4,154,273 | 5/1979 | Pollak . | |

FOREIGN PATENT DOCUMENTS

| | | | |
|---|---|---|---|
| 808939 | 7/1951 | Fed. Rep. of Germany | 145/29 R |
| 7627342 | 9/1976 | Fed. Rep. of Germany . | |
| 8204767 | 2/1982 | Fed. Rep. of Germany . | |
| 8304500 | 2/1983 | Fed. Rep. of Germany . | |
| 3204848 | 8/1983 | Fed. Rep. of Germany | 145/29 R |
| 132085 | 6/1928 | Switzerland . | |
| 368108 | 3/1959 | Switzerland . | |
| 20375 | of 1900 | United Kingdom | 145/29 R |

*Primary Examiner*—James G. Smith

*Attorney, Agent, or Firm*—Ostrolenk, Faber, Gerb & Soffen

[57] ABSTRACT

An emergency hammer for smashing panes of glass is disclosed. The hammer includes a handle and a hammer head on the handle. The hammer head has a point at one end and is connected to the handle at the opposite end. The hammer head may be integrally attached to the handle. The hammer head thus protrudes a substantial length from the handle in only one direction. A protective loop of a relatively rigid and dimensionally stable material is also on the handle and extends in the same direction for covering the hand of the person grasping the handle.

6 Claims, 1 Drawing Sheet

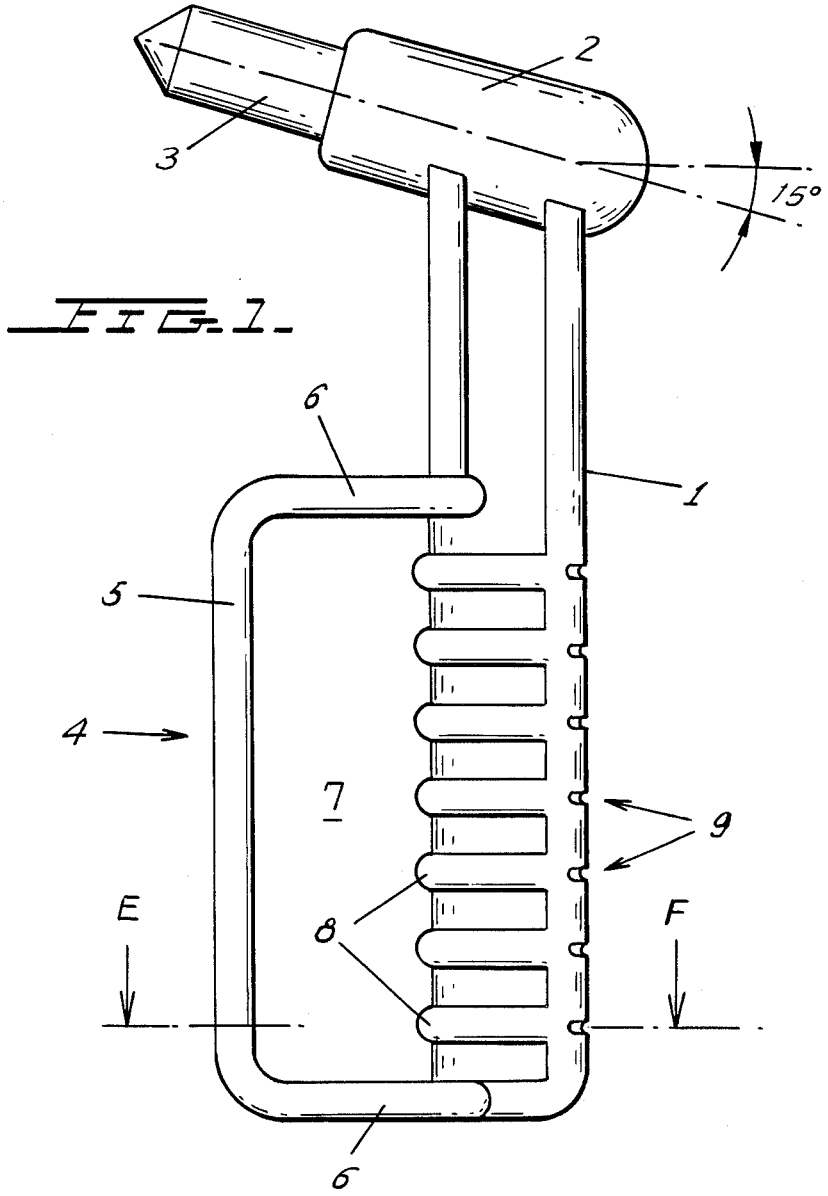
FIG. 1.
FIG. 2.
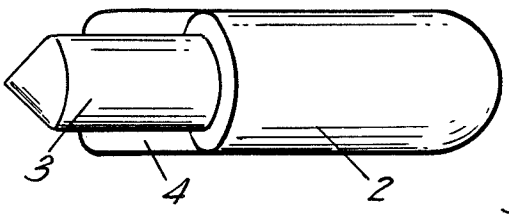
FIG. 3.
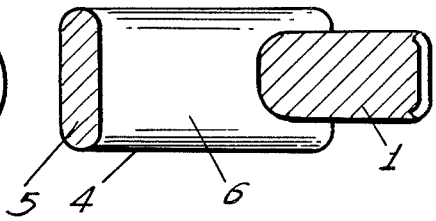

EMERGENCY HAMMER

BACKGROUND OF THE INVENTION

1. Field of the Invention

The present invention relates to an emergency hammer for breaking panes of glass, the hammer having a shaft and a hammer head on the shaft.

2. Description of the Prior Art

In general, buses and vehicles are equipped with emergency hammers. If a traffic accident prevents the doors of a vehicle from opening, the persons locked inside may use the hammers to break or smash the glass of the windows of the vehicle in order to escape from the vehicle. As a rule, the emergency hammers are arranged on the posts which separate the individual windows of the vehicle from each other.

The known emergency hammers are T-shaped, the length of the hammer head corresponding to the rather small width of the post on which it is mounted. This means that the hammer head protrudes only slightly beyond the handle both on the left side and on the right side. This is a disadvantage because it is practically impossible to break a pane of glass with the known emergency hammer without the hand which holds the handle striking the shattered glass. Very severe injuries may result.

SUMMARY OF THE INVENTION

One object of the present invention is to provide an emergency hammer of this type which considerably reduces the danger of injuring one's hand.

This and other objects of the invention are achieved by a hammer having a generally longitudinally extending handle and a hammer head connected thereto, the hammer head having a striking end with a point for striking glass formed thereon and a base end, opposite to said striking end, which is connected to the head end of the handle. Since the base end of the hammer head is coupled to the head end of the handle, the hammer head extends a substantial length from the handle (as measured along a line lying perpendicular to the axial length of the handle) in only one direction. On the side of the handle that the hammer head extends, and extending in the same direction, a protective loop of dimensionally rigid material for covering the hand of the person grasping the handle is provided.

Because the base end of the hammer head is connected to the handle, the tip end of the hammer head protrudes a greater length from the handle than was possible with prior designs wherein the hammer head was connected to the handle at approximately the midpoint of the hammer head. This in itself reduces the risk of injuring one's hand, since the risk that the knuckles of the hand will strike directly against the windowpane when the window is smashed is reduced. The loop arranged on the handle further protects the hand and makes the use of the emergency hammer safer. When a pane is smashed, the protective loop will protect the hand of the person using the hammer from striking the glass or broken pieces of the glass. The emergency hammer of the invention is therefore particularly advantageous for the smashing of multiple windowpanes. The increased protrusion of the hammer head with respect to the handle on the one side thereof and the substantial elimination of the protrusion on the other side of the handle make it possible to install the hammer in the existing space. Because of these features of the invention, the hammer head need be no longer than the hammer heads of the prior art. It is advantageous for the point of the hammer head to project further from the handle than the protective loop does, to permit the practical use of the emergency hammer.

It is particularly advantageous if the hammer head of the invention is arranged on the handle with its tip extending obliquely upward. As a result, the knuckles of the hand are still further away from the glass being smashed by the point of the hammer. Tests have shown that an emergency hammer of this shape is also suitable for use by women or children.

The protective loop is preferably U-shaped with the free ends of its sides fastened to the handle and its cross-piece extending approximately parallel to the handle. In this connection, the protective loop and the handle may suitably be formed in one piece and of the same material.

Other objects, features and advantages of the invention will be apparent from the following description, together with the accompanying drawings and the appended claims.

BRIEF DESCRIPTION OF THE DRAWINGS

The invention will be described in further detail below with reference to the drawing, in which:

FIG. 1 is a side view in elevation of an emergency hammer according to the invention;

FIG. 2 is a top view of the emergency hammer of FIG. 1; and

FIG. 3 is a cross-sectional view taken along the line E–F in FIG. 1.

DETAILED DESCRIPTION OF THE PREFERRED EMBODIMENTS

As shown in FIG. 1, the emergency hammer of the invention includes a handle 1 and a hammer head 2 arranged on the head end of the handle. The hammer head 2 is preferably integral with the handle 1 and formed of the same material. The hammer head 2 has a tip end (the left end of FIG. 1) and a base end (the right end of FIG. 2). The tip end has a point or tip 3 formed of steel or other hardened material which is adapted to strike and break glass. The base end of the hammer head 2 is connected to the handle 1 at substantially the extreme right hand end of hammer head 2 as viewed in FIG. 1 so that the handle 2 protrudes substantially only to the left side of handle 1 as viewed in FIG. 1. As a result, the overall length of the hammer head 2 required to position the tip end of the hammer head the predetermined distance to the left of the handle 1 is less than that required for prior art hammer heads.

As shown in FIG. 1, hammer head 2 is preferably arranged on handle 1 with tip 3 extending obliquely upward to a position beyond the head end of the handle. It has proven advantageous to arrange hammer head 2 with the axis along which tip 3 extends at an inclination of about 15° above a line perpendicular to the length of handle 1. This inclination also permits tip 3 to extend further from handle 1 without exceeding the width of the mounting post.

On the side of handle 1 on which the hammer head 2 protrudes toward tip 3, handle 1 supports a protective U-shaped loop 4 having a cross-piece 5 and two sides 6. The free ends of sides 6 are preferably integral with and of the same material as handle 1. As shown in FIG. 1, the lower side 6 is flush with the free end of handle 1 while the upper side 6 is arranged on handle 1 above the midpoint of the handle. The cross-piece 5 extends generally parallel to the length of handle 1. The opening 7 formed by the protective loop 4 is so dimensioned that even a large hand can pass through it. The protective loop 4 does not protrude as far from handle 1 as the tip 3 of the hammer head 2 as measured along an axis lying perpendicular to the longitudinal axis of the handle 1.

Since the protective loop 4 is intended to protect the hand of the person wielding the emergency hammer from injury upon smashing of a pane of glass, it is very important that the protective loop 4 have a relatively large width to cover the side of the hand toward the glass. Therefore, loop 4 is preferably wider than handle 1, as shown in cross-section in FIG. 3. As shown in FIG. 2, the width of loop 4 may also exceed that of tip 3, but be the same as that of hammer head 2, facilitating a flat, stable mounting of the hammer.

The emergency hammer of the invention may advantageously consist of a single cast unit except that the tip 3 is preferably separately mounted in hammer head 2. The cast unit may be either a metal casting or a plastic casting. Whatever the construction, protective loop 4 should be relatively rigid and dimensionally stable to protect the hand when glass is struck. Hammer head 2 could be molded around tip 3, of course. Tip 3 itself should be relatively heavy.

Handle 1 is preferably profiled with ribs 8 and grooves 9 formed on it, to facilitate gripping of the handle.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. An emergency hammer for smashing panes of glass, comprising:

a handle for being held by a hand, the handle having a head end;

a hammer head on the head end of the handle, the hammer head having a striking end for striking glass and a base end, opposite the striking end, the base end being connected to the head end of the handle, the hammer head extending a substantial length from the handle in one direction only; said hammer having a point at its striking end; and a relatively rigid protective loop on the handle for covering the hand holding the handle, the protective loop extending from the handle in the same direction as the hammer head; and in which the hammer head extends obliquely from the handle to the striking end, the striking end extending beyond the head end of the handle.

2. The hammer of claim 1 in which the hammer head is integral with the handle.

3. The hammer of claim 1 in which the striking end of the hammer head extends further from the handle than the protective loop extends.

4. The hammer of claim 1 in which the protective loop is U-shaped, having a cross-piece and first and second sides, each with a connected end connected to the cross-piece and a free end opposite the connected end; the free ends of the first and second sides of the loop being connected to the handle and the cross-piece of the loop extending approximately parallel to the handle.

5. The hammer of claim 1 in which the protective loop is integral with and of the same material as the handle.

6. The hammer of claim 1, wherein the handle is connected to the base end at substantially the extreme end of the base end.

* * * * *